US008443568B2

(12) United States Patent
Lin

(10) Patent No.: US 8,443,568 B2
(45) Date of Patent: May 21, 2013

(54) ADJUSTABLE HIP-END PURLIN

(75) Inventor: Jin Jie Lin, Livermore, CA (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 65 days.

(21) Appl. No.: 12/978,374

(22) Filed: Dec. 23, 2010

(65) Prior Publication Data

US 2012/0159896 A1 Jun. 28, 2012

(51) Int. Cl.
*E04C 3/02* (2006.01)

(52) U.S. Cl.
USPC ..... 52/690; 52/686; 52/655.1

(58) Field of Classification Search ..... 52/686, 52/690, 655.1, 745.21
See application file for complete search history.

(56) References Cited

U.S. PATENT DOCUMENTS

| | | | |
|---|---|---|---|
| 651,139 | A | 6/1900 | Gays |
| 688,230 | A | 12/1901 | Isrig et al. |
| 1,106,845 | A | 8/1914 | Ream |
| 1,204,956 | A | 11/1916 | Day |
| 1,214,738 | A | 2/1917 | Wolf |
| 1,378,448 | A | 5/1921 | Gilbert |
| 1,458,498 | A | 6/1923 | Piel |
| 1,461,704 | A | 7/1923 | Bonsall |
| 1,514,577 | A | 11/1924 | Burrell |
| 1,523,970 | A | 1/1925 | Jakob |
| 1,533,041 | A | 4/1925 | Slater |
| 1,558,239 | A | 10/1925 | Carline |
| 1,614,334 | A | 1/1927 | Wright |
| 1,649,226 | A | 11/1927 | Gstalder |
| 1,656,741 | A | 1/1928 | Lane |
| 1,685,729 | A | 9/1928 | Stone |
| 1,880,480 | A | 10/1932 | Ragsdale |
| 2,037,736 | A | 4/1936 | Payne |
| 2,042,370 | A | 5/1936 | Walker |
| 2,116,263 | A | 5/1938 | Harbaugh |
| 2,302,101 | A | 11/1942 | Boydstun |
| 2,338,435 | A | 1/1944 | Hoyt |
| 2,567,586 | A | 9/1951 | Werder |
| 2,619,887 | A | 12/1952 | Burrows |
| 2,670,919 | A | 3/1954 | Esoldi |
| 2,686,959 | A | 8/1954 | Robinson |
| 2,806,495 | A | 9/1957 | Merkle et al. |
| 2,856,646 | A | 10/1958 | Latimer et al. |
| 2,947,119 | A | 8/1960 | Puckett, Jr. |

(Continued)

FOREIGN PATENT DOCUMENTS

| | | | |
|---|---|---|---|
| AU | 0484192 | A1 | 6/1974 |
| CA | 0502492 | | 5/1954 |

(Continued)

OTHER PUBLICATIONS

"META/HETA/HHETA/HETAL/TSS Embedded Truss Anchors and Truss Seat Snap-In". Simpson Strong-Tie Wood Connectors Catalog, 1999, p. 108. Simpson Strong-Tie Company, Inc., U.S.A.

(Continued)

*Primary Examiner* — Jeanette E Chapman
*Assistant Examiner* — Daniel Kenny
(74) *Attorney, Agent, or Firm* — Charles R Cypher; James R. Cypher

(57) ABSTRACT

A structural connection between the upper outer edges of multiple structural members with one or more elongate connectors that span from edge to edge between pairs of structural members.

26 Claims, 11 Drawing Sheets

U.S. PATENT DOCUMENTS

| | | | |
|---|---|---|---|
| 2,963,127 | A | 12/1960 | Manville |
| 2,964,807 | A | 12/1960 | Kennedy |
| 3,000,145 | A | 9/1961 | Fine |
| 3,010,162 | A | 11/1961 | Klein |
| 3,011,229 | A | 12/1961 | Mutchnik |
| 3,080,084 | A | 3/1963 | Appleton |
| 3,102,306 | A | 9/1963 | Hutchinson |
| 3,152,671 | A | 10/1964 | Mallory, Jr. |
| 3,163,386 | A | 12/1964 | Collins |
| 3,201,874 | A | 8/1965 | Christy |
| 3,214,126 | A | 10/1965 | Roos |
| 3,332,196 | A | 7/1967 | Tuttle |
| 3,335,993 | A | 8/1967 | Tuttle |
| 3,389,885 | A | 6/1968 | Friedman et al. |
| 3,422,585 | A | 1/1969 | Dismukes |
| 3,467,418 | A | 9/1969 | Redditt |
| 3,518,421 | A | 6/1970 | Gogdill |
| 3,528,636 | A | 9/1970 | Schmit |
| 3,591,997 | A | 7/1971 | Tennison et al. |
| 3,718,307 | A | 2/1973 | Albanese |
| 3,778,952 | A | 12/1973 | Soucy |
| 3,875,719 | A | 4/1975 | Menge |
| 3,959,945 | A | 6/1976 | Allen |
| 3,988,872 | A | 11/1976 | Adamson et al. |
| 4,016,698 | A | 4/1977 | Rogers |
| 4,040,232 | A | 8/1977 | Snow et al. |
| 4,062,512 | A | 12/1977 | Arnold |
| 4,171,172 | A | 10/1979 | Johnston |
| 4,234,174 | A | 11/1980 | Cardono |
| 4,237,614 | A | 12/1980 | Williams |
| 4,246,736 | A | 1/1981 | Kovar et al. |
| 4,253,224 | A | 3/1981 | Hickman et al. |
| 4,253,649 | A | 3/1981 | Hewson |
| 4,322,064 | A | 3/1982 | Jarvis |
| 4,339,903 | A | 7/1982 | Menge |
| 4,342,177 | A | 8/1982 | Smith |
| 4,350,279 | A | 9/1982 | Haley |
| 4,361,999 | A | 12/1982 | Sidney |
| 4,370,843 | A | 2/1983 | Menge |
| 4,420,921 | A | 12/1983 | Hardin |
| 4,422,792 | A | 12/1983 | Gilb |
| 4,490,956 | A | 1/1985 | Palacio et al. |
| 4,503,652 | A | 3/1985 | Turner |
| 4,513,994 | A | 4/1985 | Dover et al. |
| 4,524,554 | A | 6/1985 | Simpson |
| 4,563,851 | A | 1/1986 | Long |
| 4,570,407 | A | 2/1986 | Palacio et al. |
| 4,604,845 | A | 8/1986 | Brinker |
| 4,625,415 | A | 12/1986 | Diamontis |
| 4,637,195 | A | 1/1987 | Davis |
| 4,669,235 | A | 6/1987 | Reinen |
| 4,704,829 | A | 11/1987 | Baumker, Jr. |
| D293,416 | S | 12/1987 | Krueger |
| 4,712,340 | A | 12/1987 | Sogge |
| 4,717,101 | A | 1/1988 | Harrod |
| 4,843,726 | A | 7/1989 | Ward |
| 4,928,867 | A | 5/1990 | Jensen |
| 4,958,814 | A | 9/1990 | Johnson |
| 5,031,886 | A | 7/1991 | Sosebee |
| D318,785 | S | 8/1991 | Dean |
| 5,044,582 | A | 9/1991 | Walters |
| 5,074,515 | A | 12/1991 | Carter, Jr. |
| 5,129,153 | A | 7/1992 | Burns, Sr. |
| 5,161,345 | A | 11/1992 | Sobjack, Sr. |
| 5,214,900 | A | 6/1993 | Folkerts |
| 5,240,032 | A | 8/1993 | Mizioch |
| 5,315,803 | A | 5/1994 | Turner |
| 5,324,132 | A | 6/1994 | Hunter et al. |
| 5,367,853 | A | 11/1994 | Bryan |
| 5,388,378 | A | 2/1995 | Frye |
| 5,407,182 | A | 4/1995 | Hartley |
| 5,412,920 | A | 5/1995 | Hess |
| 5,454,203 | A | 10/1995 | Turner |
| 5,490,334 | A | 2/1996 | Payne |
| 5,502,942 | A | 4/1996 | Gras et al. |
| 5,524,854 | A | 6/1996 | McSwain |
| 5,555,694 | A | 9/1996 | Commins |
| 5,606,837 | A | 3/1997 | Holizlander |
| 5,628,119 | A | 5/1997 | Bingham et al. |
| 5,638,655 | A | 6/1997 | Keck |
| 5,678,799 | A | 10/1997 | Jorgensen |
| 5,699,639 | A | 12/1997 | Fernandez |
| 5,884,411 | A | 3/1999 | Raber |
| 5,884,448 | A | 3/1999 | Pellock |
| 5,899,042 | A | 5/1999 | Pellock |
| 5,934,631 | A | 8/1999 | Becker |
| 5,937,531 | A | 8/1999 | Menk et al. |
| 5,937,608 | A | 8/1999 | Kucirka |
| 5,938,157 | A | 8/1999 | Reiker |
| 5,992,122 | A | 11/1999 | Rohrmoser et al. |
| 6,070,336 | A | 6/2000 | Rodgers |
| 6,155,019 | A | 12/2000 | Ashton et al. |
| 6,170,218 | B1 | 1/2001 | Shahnazarian |
| 6,185,898 | B1 | 2/2001 | Pratt |
| 6,230,466 | B1 | 5/2001 | Pryor |
| 6,230,467 | B1 | 5/2001 | Leek |
| 6,393,794 | B1 * | 5/2002 | Pellock ..... 52/696 |
| 6,463,711 | B1 | 10/2002 | Callies |
| 6,523,321 | B1 | 2/2003 | Leek et al. |
| 6,546,678 | B1 | 4/2003 | Ashton et al. |
| 6,988,346 | B2 | 1/2006 | Shamroukh et al. |
| 6,993,882 | B2 | 2/2006 | Crawford et al. |
| 7,748,187 | B2 | 7/2010 | Sensenig |
| 2005/0098697 | A1 | 5/2005 | Collins |
| 2007/0200039 | A1 | 8/2007 | Petak |
| 2009/0151294 | A1 * | 6/2009 | Staley ..... 52/655.1 |
| 2011/0154770 | A1 * | 6/2011 | Friis ..... 52/696 |

FOREIGN PATENT DOCUMENTS

| | | | |
|---|---|---|---|
| DE | 29819351 | | 3/1999 |
| GB | 2039582 | | 8/1980 |
| GB | 2163788 | A | 3/1986 |
| GB | 2228955 | A | 9/1990 |
| WO | WO9629180 | A1 | 9/1996 |

OTHER PUBLICATIONS

"Lochbänder," "Lochblechstreifen," "Spanngerät" and "Spanngerät Typ 60." BMF product brochure, 1990, pp. 5 and 8, BMF Baubeschläge GmbH & Co. KG., Denmark.

"BMF Vindafstivningsstem 25", product brochure, 2000, 2 pages, BMF Bygningsbeslag A/S. Odder, Denmark.

"BMF Vindafstivningssystem 40/60", product brochure, 2000, 2 pages, BMF Bygningsbeslag A/S. Odder, Denmark.

"BMF Vindafstivningssystem." BMF Vindafstivningssystem product catalog, 2000, BMF Bygningsbeslag A/S. Odder, Denmark.

"Hulband, vindtrækband, bandstrammer, bandspænder." BMF Handvaerkerkatalog, Section 4,1989, pp. 4.00.0-4.11.1, BMF Bygningsbeslag A/S. Odder, Denmark.

"The Stabilizer Truss Brace", brochure, publication date unknown, 2 pgs., Mitek, Inc., U.S.A.

"Mitek Stabilizer, Report No. NER-561", Jul. 1, 2000, p. 1-3, National Evaluation Service, Inc., U.S.A.

"TS TST TUC Truss Products," Tee-Lok Wood Connectors,1995, p. 10, Tee-Lok Corporation, U.S.A.

"Truslock Spacing Tools" Advertisement in Journal of Light Construction, Sep. 1999, Builderburg Partners, Ltd., U.S.A.

"Don't Just Space It, Brace-It", brochure, publication date unknown, 2 pages, Truswal System, U.S.A.

Mike Guertin, "Adjustable Trusss Braces" Journal of Light Construction, Mar. 1999, p. 10, Builderburg Partners, Ltd., U.S.A.

Rick Arnold and Mike Guertin, "Installing Gable Roof Trusses," Journal of Light Construction, Dec. 1998, pp. 37-42, Builderburg Partners, Ltd., U.S.A.

"Space and Brace Trusses Simply by Folding Over," Truslock-Spacing Tools, date of publication unknown, p. 4, Trulock, USA.

"TSX Truss Spacer", publication date unknown, 2 pgs., United Steel Products Company, U.S.A.

"Commentary and Recommendations for Handling and Installing Bracing, HIB-91", 1991, Truss Plate Institute, U.S.A.

"Encyclopedia of Trusses", publication date unknown, pp. 10-14, Alpine Engineered Products, U.S.A.

* cited by examiner

ADJUSTABLE HIP-END PURLIN

BACKGROUND OF THE INVENTION

The present invention relates to a connection, in particular the connection between purlins and hip roof trusses, for hip roof construction. A hip roof, or hipped roof, is a type of roof where all sides slope downwards to the walls, usually with a fairly gentle slope. Thus it is a house with no gables or other vertical sides to the roof. A square hip roof is shaped like a pyramid. Hip roofs on rectangular houses will have two triangular sides and two trapezoidal ones. A hip roof on a rectangular plan has four faces. They are almost always at the same pitch or slope, which makes them symmetrical about the centerlines. Hip roofs have a consistent level fascia, meaning that a gutter can be fitted all around. Hip roofs often have dormer slanted sides.

Hip roofs are more difficult to construct than a gabled roof, requiring somewhat more complex systems of trusses. Although the roof itself is harder to construct, the walls that carry the roof are easier to build, being all one level. Hip roofs can be constructed on a wide variety of plan shapes. Each ridge is central over the rectangle of building below it. The triangular faces of the roof are called the hip ends, and they are bounded by the hips themselves. The hips sit on an external corner of the building and rise to the ridge. Where the building has an internal corner a valley makes the joint between the sloping surfaces. They have the advantage of giving a compact, solid appearance to a structure.

In modern domestic architecture, hip roofs have been seen to represent comfort, practicality, and solidness. They are thus commonly seen in bungalows and cottages, and have been integral to styles such as the American Foursquare. However, the hip roof has been used in many different styles of architecture and in a wide array of structures. A hip roof is self-bracing. It does not need the same amount of diagonal bracing (wind bracing) that a gable roof requires.

A hip roof is also ideal to have in hurricane regions. It holds up much better to high winds. In areas like Northern Australia, or the Gulf Coast of the Southeastern United States, that are subject to high wind loadings and strict construction codes this could be a factor in deciding which type of roof to build. If the slope of the roof from horizontal is 35 degrees or greater it will reduce/eliminate the airfoil effect of extreme high winds that blow over the roof and a hip roof is far less likely to peel off the house than a gable end roof. To this end, since 2001 the State of Florida has required insurance companies to offer a premium discount to customers who can prove they have a hip roof, which they do by obtaining a windstorm inspection. The hip roof also exhibits increased survivability in tornado winds and hurricanes. They are stable.

One advantage of a hip roof is that it has eaves all round. These protect the walls from the weather and help to shade the walls (and the windows in them) from the sun, thus reducing the power needed to cool the structure in warm climates. A gable roof does not shade the walls at the gables.

In architecture or structural engineering or building, a purlin is a generally horizontal structural member in a roof. Purlins support the loads from the roof deck or sheathing and are supported by the principal rafters and/or the building walls, steel beams etc. The use of purlins, as opposed to closely spaced rafters, is common in pre-engineered metal building systems and some timber frame construction.

In lightweight timber roof construction under purlins are used to support rafters over longer spans than the rafters alone could span. Under purlins are typically propped off internal walls. For example, an 8×4 under purlin would support the center of a row of 6×2 rafters that in turn would support 3×2 roof purlins to which the roof cladding was fixed.

In traditional timber truss construction purlins are supported by the principal rafters of the truss.

In all metal or mixed building roof systems, purlin members are frequently constructed from cold-formed steel, (or roll formed) C or Z sections. The Z sections can be lapped and nested at the supports which creates a continuous beam configuration between the bays. When C and Z sections are used in wall construction it is normal to call them girts.

The present invention replaces cut-to-size (and angle) purlins and temporary braces with permanent connectors that brace the connected structural members and permit sheathing to be applied directly thereover. The present invention provides a sloped surface for attaching the sheathing or decking of the roof in a convenient and efficient manner when stepped hip ridge trusses are used, without having to shape the top chords of the trusses to the particular slope of the roof or to cut individual purlins.

SUMMARY OF THE INVENTION

The present invention is a connection, preferably between step-down trusses in hip roof framing. The connection of the present invention is based on a structural purlin that also serves as an installation lateral restraint and spacer during the truss erection process. The connector attaches to the leading edge of step-down hip trusses, eliminating the need for drop-top chords, 2× lumber, gable end fillers or C-stud fillers. The interlocking design of the connectors allows them to install linearly, aligned with the end jacks, to maintain framing spacing from eave to hip or peak. Roof sheathing or decking attaches directly to the purlin with knurled pneumatic fasteners or low-profile head, self-drilling screws. Adjustable in length, the connector is designed to accommodate a pitch range of 3/12 to 9/12 as a structural purlin and up to 12/12 as an installation lateral restraint and spacer. The purlin accurately spaces the installed trusses and helps meet temporary top-chord lateral restraint recommendations on step-down hip ends.

DETAILED DESCRIPTION OF THE INVENTION

Figure 13:
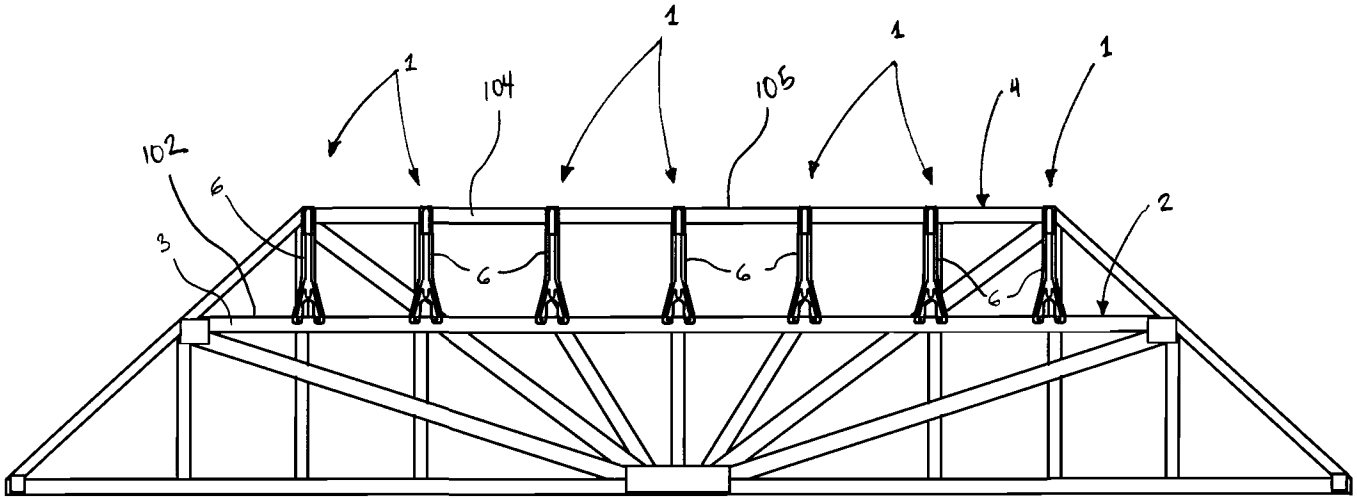
FIG. 13 is an elevation view of connections of the present invention including multiple connectors and two connected top chords.

As shown in FIG. 13, the present invention is a structural connection 1 in a structure 100. The structure 100 is preferably a wood frame or cold-formed steel frame building, although the framing may be of any composition. Preferably, the connection 1 is made in a hip roof.

Figure 10:
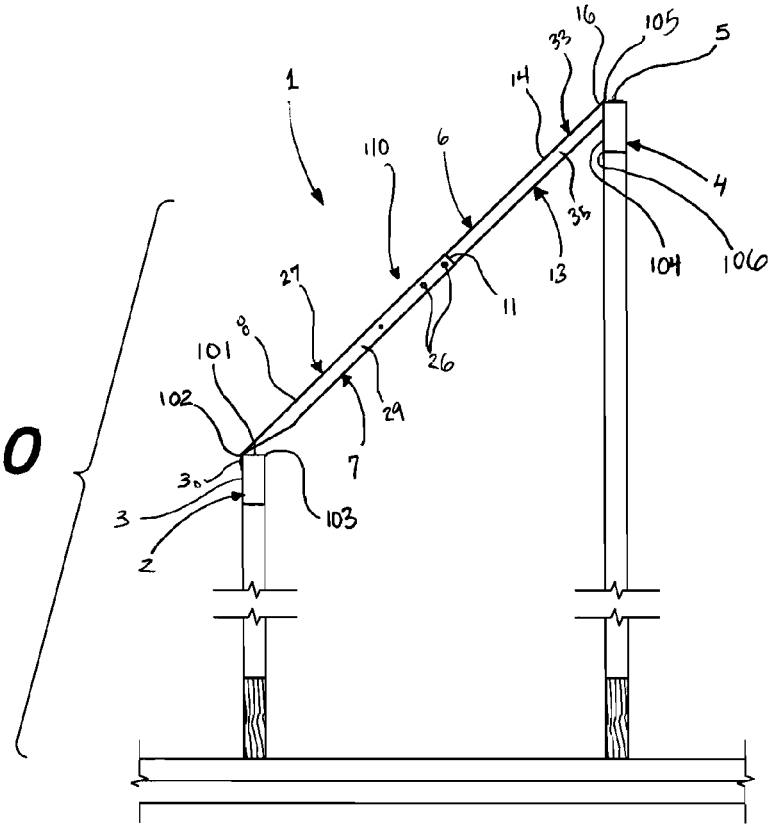
FIG. 10 is a right side elevation view of a connection of the present invention, showing a relatively steep pitch and long extension of a connector of the present invention.
Figure 11:
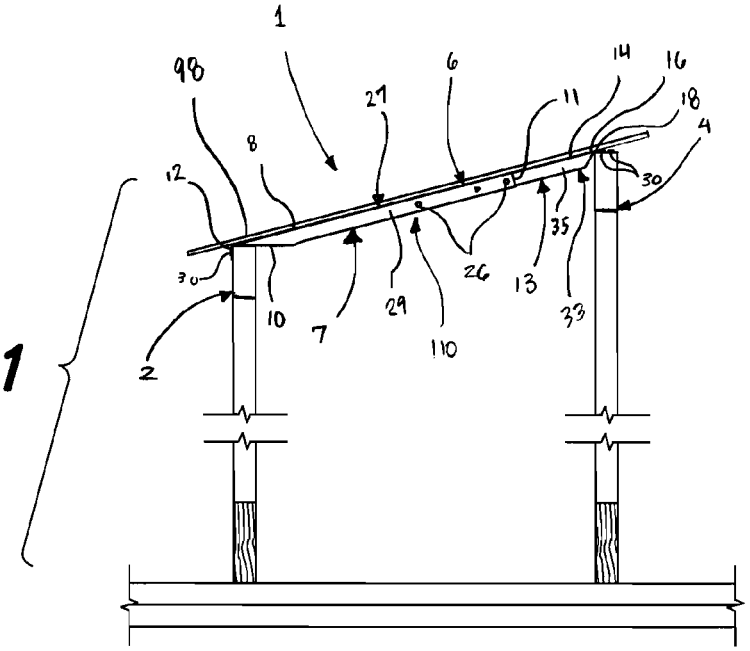
FIG. 11 is a right side elevation view of a connection of the present invention, showing a relatively shallow pitch and short extension of a connector of the present invention.

As shown in FIGS. 10 and 11, the structural connection 1 of the present invention comprises a first lower structural member 2, a first upper structural member 4 and a first connector 6 that attaches the lower structural member 2 to the upper structural member 4. The connection 1 is preferably between step-down hip trusses in a hipped roof. Preferably, the connector is an adjustable hip end purlin that is both angularly adjustable, to accommodate different roof pitches, and adjustable in length, to accommodate different truss spacings. The connector 6 preferably accommodates a pitch range of 3/12 to 9/12, which corresponds to an angle range of 14.04° to 36.87°.

As shown in FIGS. 10-13, the first lower structural member 2 preferably has a first lower surface 3 and a second lower surface 101. The first lower surface 3 and said second lower surface 101 are joined at a first lower juncture 102. The second lower surface 101 has a first lower inner edge 103 opposite the first lower juncture 102. Preferably, the first upper structural member 4 has a first upper surface 5 and a second upper surface 104. The first upper surface 5 and the second upper surface 104 are joined at a first upper juncture 105. The second upper surface 104 has a first upper inner edge 106 opposite said first upper juncture 105. The surfaces of the structural members 2, 4 are preferably joined at right angles to each other and normally the structural members 2, 4 will each have four sides and rectangular cross-sections.

The first connector 6 comprises a first elongate component 110 that has a first elongate web 107 and a first elongate flange 108. The first elongate web 107 and the first elongate flange 108 are angularly joined along a first elongate juncture 109. Preferably, the connector 6 of the present invention is formed from sheet metal, specifically 33 mil (20 gauge) galvanized sheet steel, but it can be made from any suitable material such as cast aluminum. If the connector 6 is made from sheet metal, the junctures will be bends.

In the connection 1 of the present invention, the first connector 6 is attached to said lower structural member 2 and to the upper structural member 4. The attachments are preferably made with separate mechanical fasteners such as nails or screws, but they can be made in any suitable way such as with welds or adhesives.

The upper structural member 4, where the first connector 6 is attached, is elevated higher in the structure 100 than said lower structural member 2, where the first connector 6 is attached. In the most preferred embodiment, the connector 6 is attached to the top chords of two step-down hip trusses in a roof. The nature of step-down trusses is that the top chords in any pair are at different elevations in the building.

The first elongate web 107 of the connector 6 extends from the first lower juncture 102 in the first lower structural member 2 to the first upper juncture 105 in the upper structural member 4. In this manner, the connector 6, and any number of connectors 6, can be used to connect a pair of structural members, or any number of structural members, while presenting a planar surface that can accept sheathing without gaps or steps.

The first elongate web 107 extends from the first lower juncture 102 to the first upper juncture 105. The first elongate web 107 does not contact said first lower inner edge 103. Preferably, it also does not contact the first upper inner edge 106. In other words, the first elongate web 107 preferably angles away from the adjacent surfaces of the structural members. The first elongate web 107 runs between the upper outer edges of adjacent pairs of structural members.

The first elongate flange 108 does not pass through the lower structural member 2 and it also does not pass through the upper structural member 4. Preferably, the first elongate flange 108 tapers adjacent the structural members so that it does not make contact with either.

Figure 1:
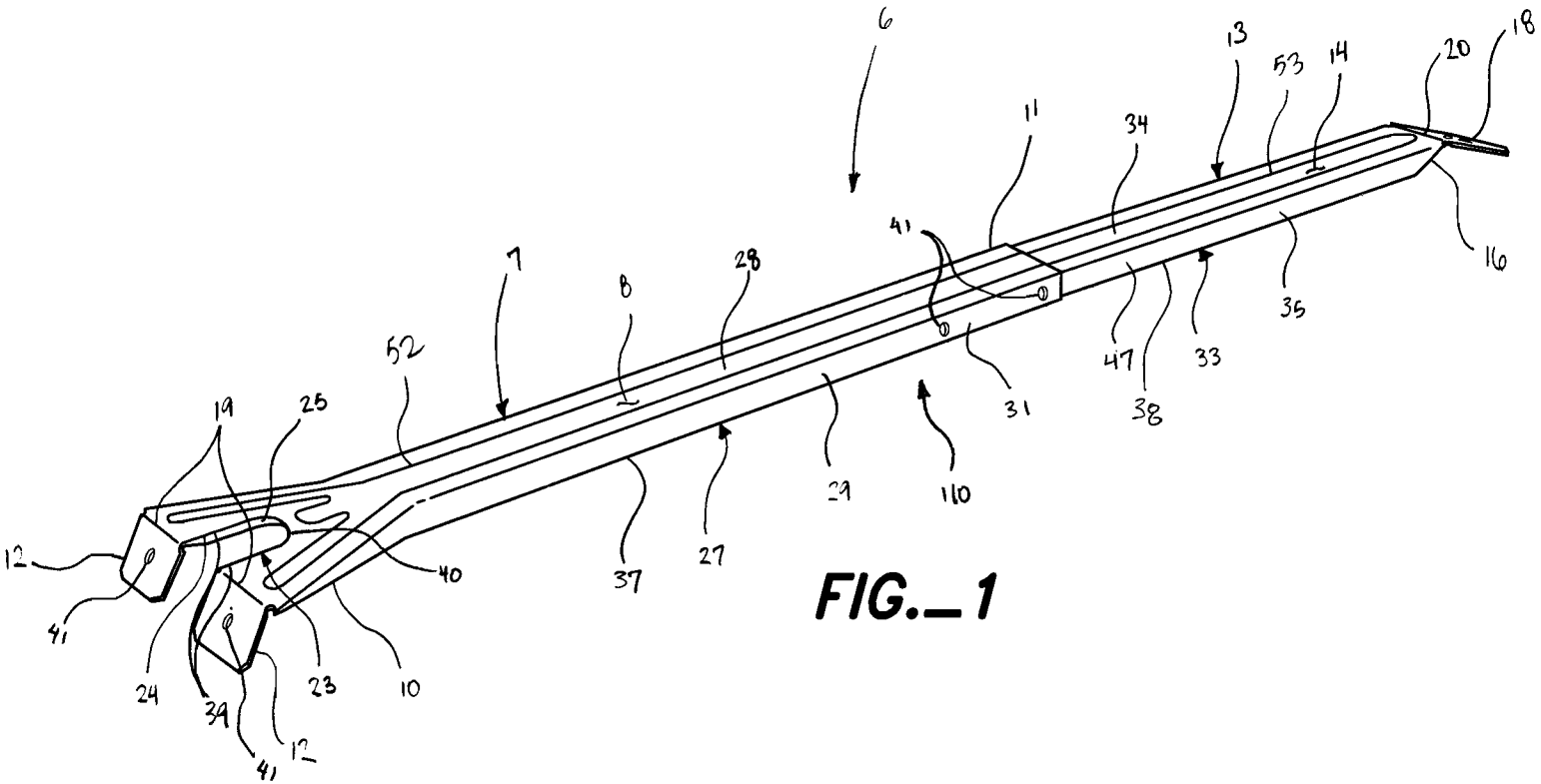
FIG. 1 is a perspective view of a connector of the present invention.
Figure 2:
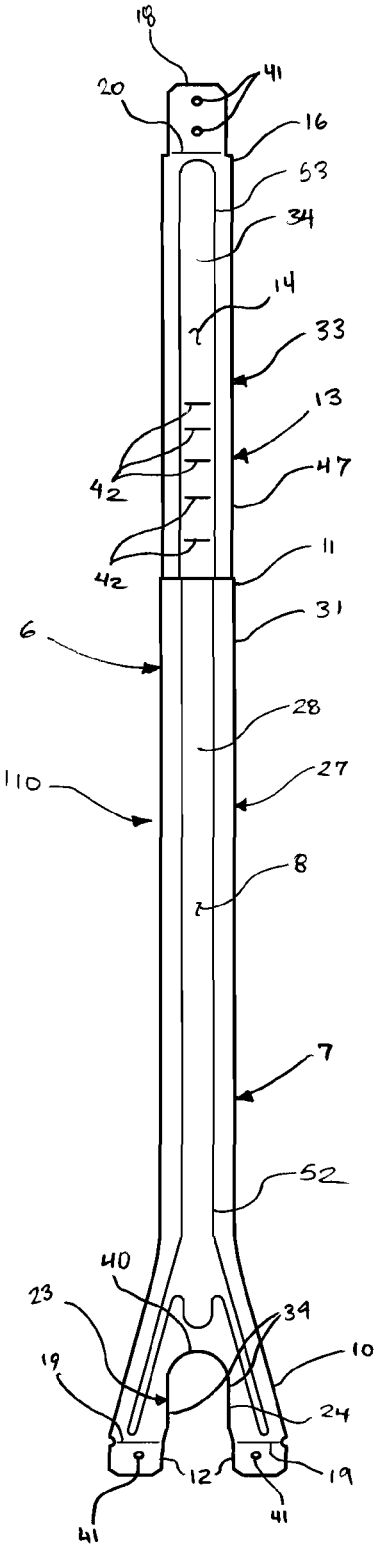
FIG. 2 is a top plan view of a connector of the present invention.

As shown in FIG. 1, preferably the connector 6 is an adjustable-length connector 6 and the first elongate component 110 comprises a first elongate member 7 and a second elongate member 13 connected to the first elongate member 7.

The first elongate member 7 preferably has a first body portion 27 and the second elongate member 13 preferably has a second body portion 33. The two body portions are preferably in sliding or telescoping engagement with each other before being mutually connected and fixed, preferably with separate mechanical fasteners.

Preferably the first body portion 27 has a first web portion 28 with a first upper surface 8 and a first lower surface 9, a lower attachment end 10 and an upper end 11. The lower attachment end 10 includes a first angularly-adjustable lower tab 12. The first body portion has a first lower flange portion 29 that is angularly joined to the first web portion 28 along a first lower juncture portion 32 and has a first lower edge 37.

Preferably, the second body portion 33 has a second web portion 34 with a second upper surface 14 and a second lower surface 15, an upper attachment end 16 and a lower end 17. The upper attachment end 16 includes a first upper angularly-adjustable tab 18. The second body portion 33 has a first upper flange portion 35 that is angularly joined to the second web portion 34 along a first upper juncture portion 36 and has a first upper edge 38.

The first web portion 28 of the first body portion 27 and the second web portion 34 of the second body portion 33 are parts of the first elongate web 107. The first lower flange portion 29 and the first upper flange portion 35 are parts of the first elongate flange 108.

Figure 3:
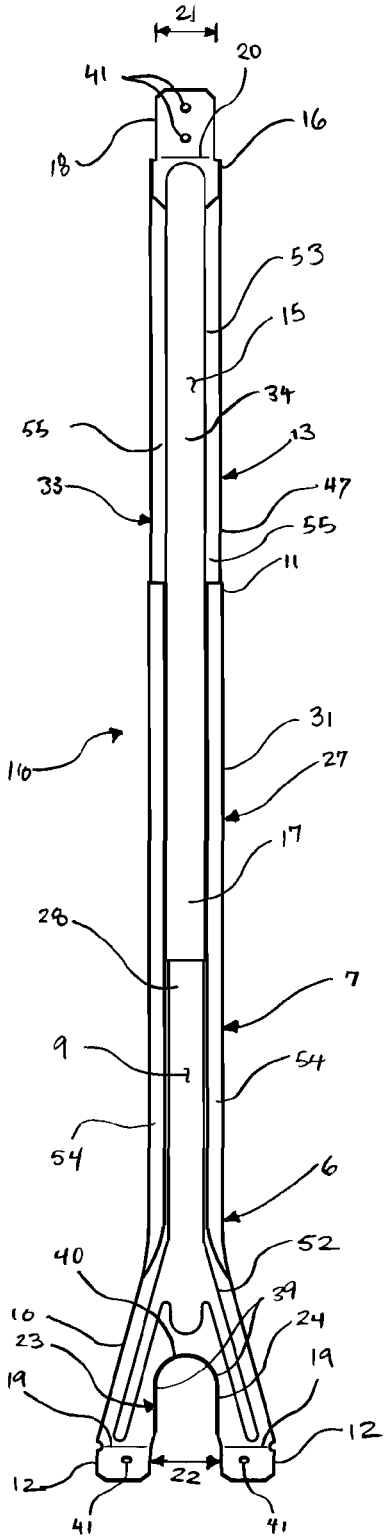
FIG. 3 is a bottom plan view of a connector of the present invention.
Figure 4:
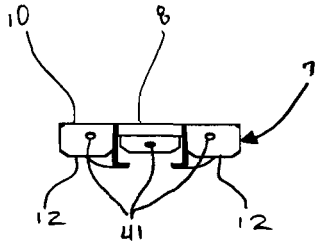
FIG. 4 is an elevation view looking at the lower attachment end of a connector of the present invention.
Figure 5:
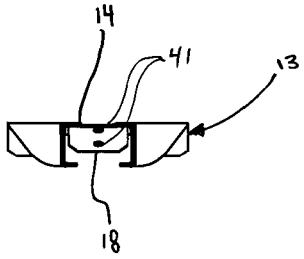
FIG. 5 is an elevation view looking at the upper attachment end of a connector of the present invention.
Figure 8A:
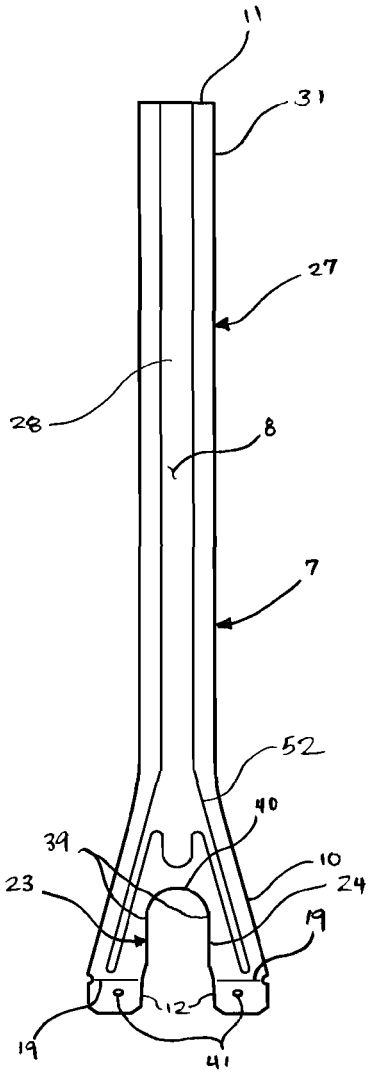
FIG. 8A is a top plan view of a first elongate member of a connector of the present invention.
Figure 8B:
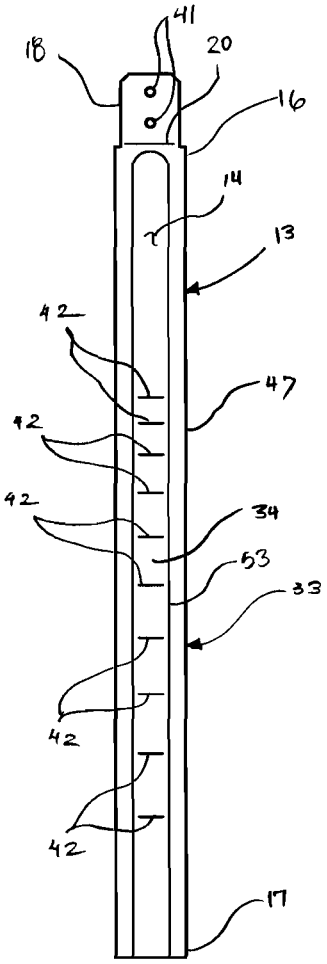
FIG. 8B is a top plan view of a second elongate member of a connector of the present invention.
Figure 6:
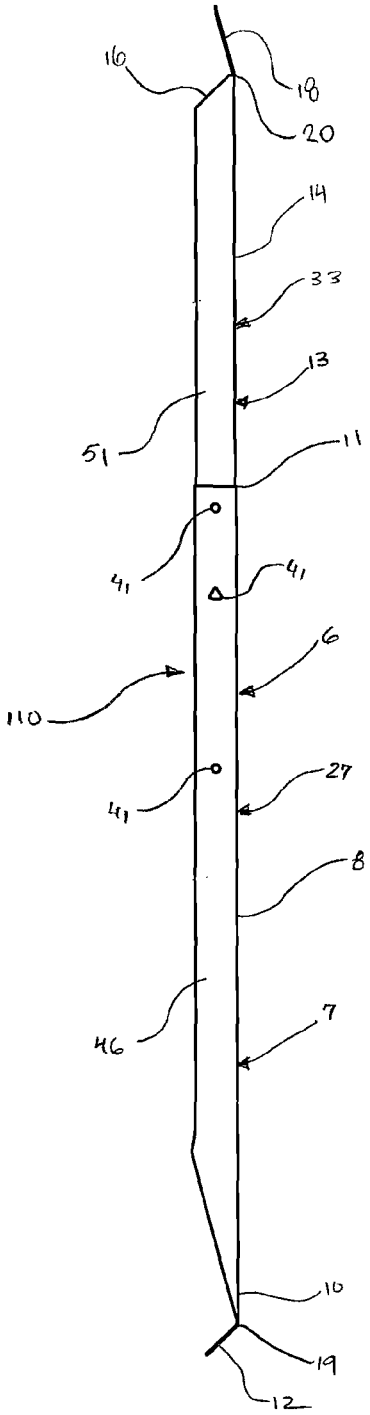
FIG. 6 is a left side elevation view of a connector of the present invention.
Figure 7:
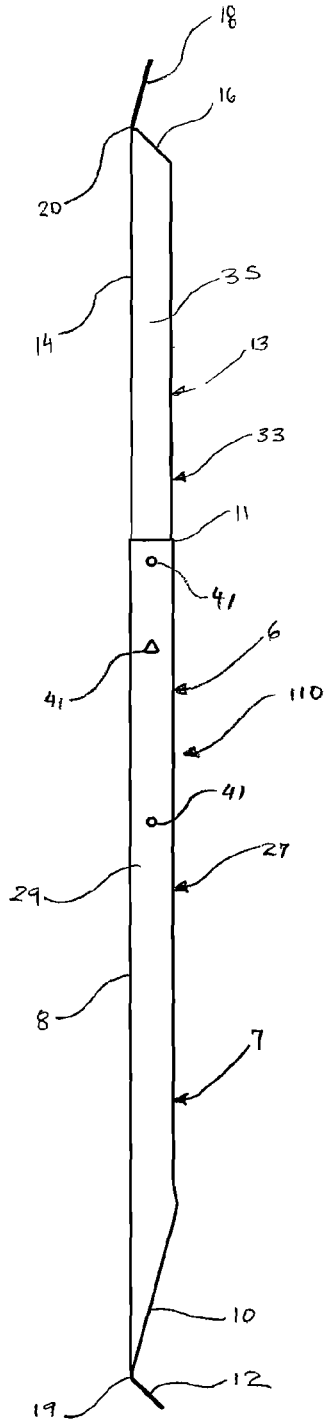
FIG. 7 is a right side elevation view of a connector of the present invention.

As shown in FIGS. 1 and 3, preferably one of the first upper surface 8 and the first lower surface 9 of the first web portion 28 interfaces with one of the second upper surface 14 and the second lower surface 15 of the second web portion 34. As shown in FIGS. 12-13, the first lower tab 12 interface with the first lower surface 3 of the lower structural member 2. The first upper tab 18 interfaces with said first upper surface 5 of said upper structural member 4.

The first upper edge 38 of the first upper flange portion 35 preferably tapers toward the upper juncture portion 36 proximate the first upper tab 18.

Preferably, the attachment end 10 of the first web portion 28 includes a second angularly-adjustable lower tab 12. The first and second lower tabs 12 preferably are joined to the first body portion 27 of the first elongate member 7 at first and second lower angular junctures 19. The first upper tab 18 is joined to the second body portion 33 of the second elongate member 13 at a first upper angular juncture 20. Preferably, the angular junctures can be field bent or adjusted to accommodate different pitches between the connected structural members. The first upper tab 18 is preferably attached with two #10 screws. Preferably, the first and second lower tabs 12 are each attached with one #10 self-drilling tapping screws when the structural members are cold-formed steel.

The first and second lower junctures 19 are preferably discontinuous. Preferably, the first upper tab 18 has a first width 21. The first and second lower tabs 12 are separated by a spacing 22 that is at least equal to the first width 21. Ideally, the first width 21 and the spacing 22 are almost identical, so that the upper tab 18 of one connector 6 fits exactly between the lower tabs 12 of the next, higher, connector 6, and connectors 6 can be installed inline and in series, as shown in FIG. 15A.

Figure 9A:
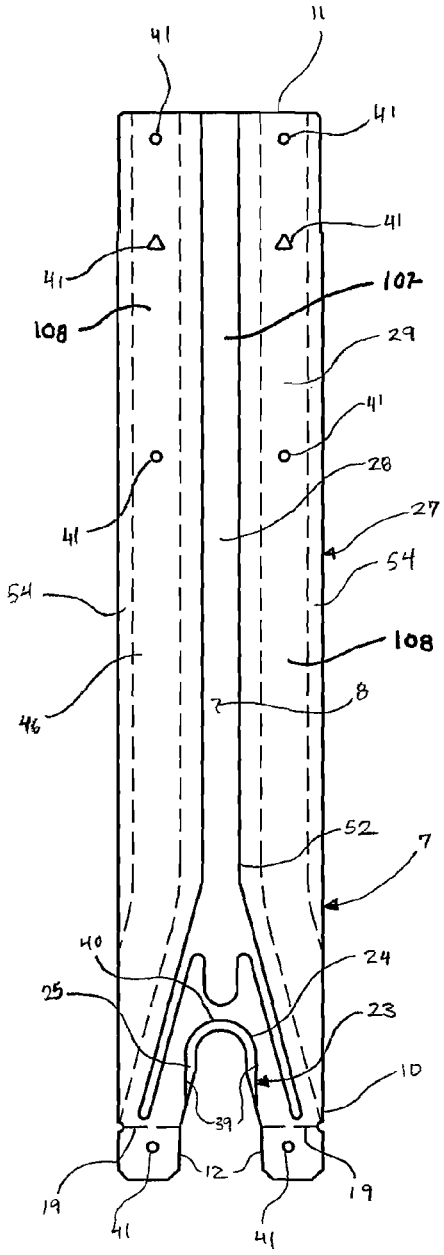
FIG. 9A is a top plan view of a sheet metal blank, after cutting but before bending, of a first elongate member of a connector of the present invention.
Figure 9B:
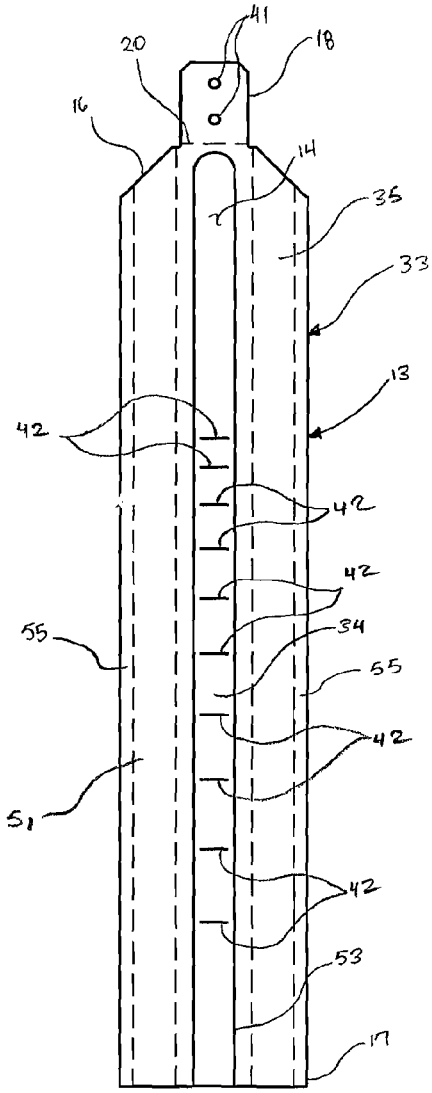
FIG. 9B is a top plan view of a sheet metal blank, after cutting but before bending, of a second elongate member of a connector of the present invention.

As shown in FIGS. 1 and 9A, preferably the first and second lower junctures 19 are separated by a slot 23 in the lower attachment end 10 of the connector 6. The slot 23 is preferably u-shaped. Preferably, the slot 23 is defined by an inner edge 24 reinforced by an edge flange 25. The slot 23 preferably has first and second sides 39 joined by a curved end 40. Preferably, the edge flange 25 tapers toward the inner edge 24 proximate the first and second lower tabs 12.

Figure 12A:
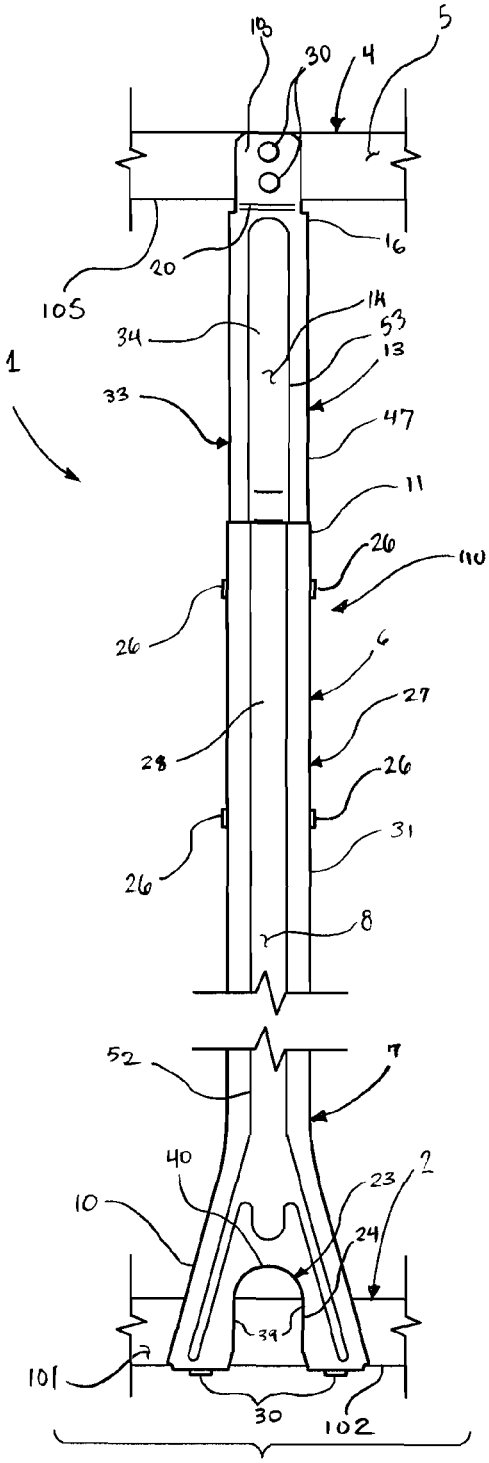
FIG. 12A is a top plan view of a connection of the present invention.
Figure 12B:
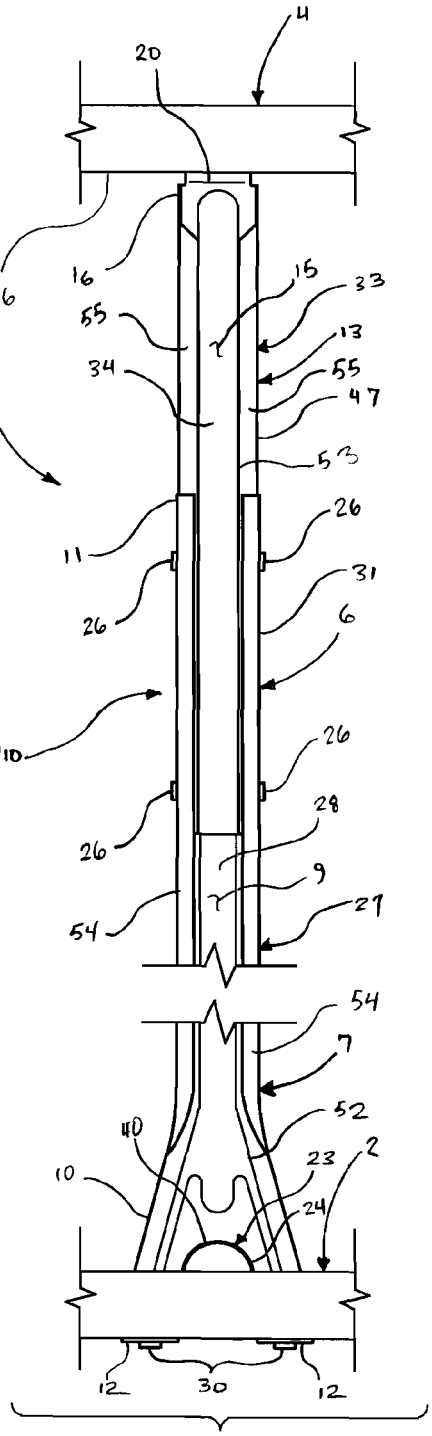
FIG. 12B is a bottom plan view of a connection of the present invention.

The first elongate member 7 is preferably fastened to the second elongate member 13 with a plurality of mechanical fasteners 26, and the mechanical fasteners 26 preferably are screws 26, as shown in FIGS. 12A-12B.

Preferably, the first lower surface 3 of the lower structural member 2 is a substantially vertical outer attachment surface 3 and the first upper surface 5 of the upper structural member 4 is a substantially horizontal upper attachment surface 5. The outer attachment surface 3 faces away from the greater part of the connector 6, and the upper attachment surface 5 is above the greater part of the connector 6. Because the connector 6 interfaces with the outer attachment surface 3 at one end and to the upper attachment surface 5 at the other, the connector can resist the tension of these surfaces pulling apart.

The first and second lower tabs 12 are preferably fastened to the outer attachment surface 3 with one or more separate fasteners 30. The first upper tab 18 is fastened to the upper attachment surface 5 with one or more separate fasteners 30. The fasteners 30 are orthogonal to the tabs and the attachment surfaces are at acute angles to the connector 6, which allows the tab attachments to resist in both tension and compression.

Preferably, the first elongate member 7 is formed at least in part as a first channel 31 wherein the first body portion 27 has a first web portion 28 with a first upper surface 8 and a first lower surface 9, a first lower side flange portion 29 and a second lower side flange portion 46 of a second elongate flange 108. The second elongate member 13 is formed at least in part as a second channel 47 that has a second web portion 34 with a second upper surface 14 and a second lower surface 15, a first upper side flange portion 35 and a second upper side flange portion 51 of the second elongate flange 108. Each pair of side flanges is preferably connected with two #10 screws 26.

As shown in FIG. 3, the first channel 31 preferably has a pair of first reinforcing flanges 54 and the second channel 47 preferably has a second pair of first reinforcing flanges 55. The reinforcing flanges 54, 55 stiffen the channels 31, 47 and also create incomplete tubes that prevent the two channels 31, 47 from being separated except by longitudinal withdrawal of one from the other, easing handling and installation.

The first elongate member 7 preferably broadens at the lower attachment end 10 so that the first web portion 28 also broadens, creating space for two lower tabs 12 separated by a slot 23. The first lower side flange portion 29 tapers toward the first lower tab 12, and the second lower side flange portion 46 tapers toward the second lower tab 12. Preferably, the first upper side flange portion 35 tapers toward the first upper tab 18, and the second upper side flange portion 51 also tapers toward the first upper tab 18. The side flanges taper so that connector 6 does not interfere with the structural members 2, 4.

As shown in FIG. 13, preferably the lower structural member 2 is a first step-down hip truss 2 and the upper structural member is 4 a second step-down hip truss 4.

Figure 15:
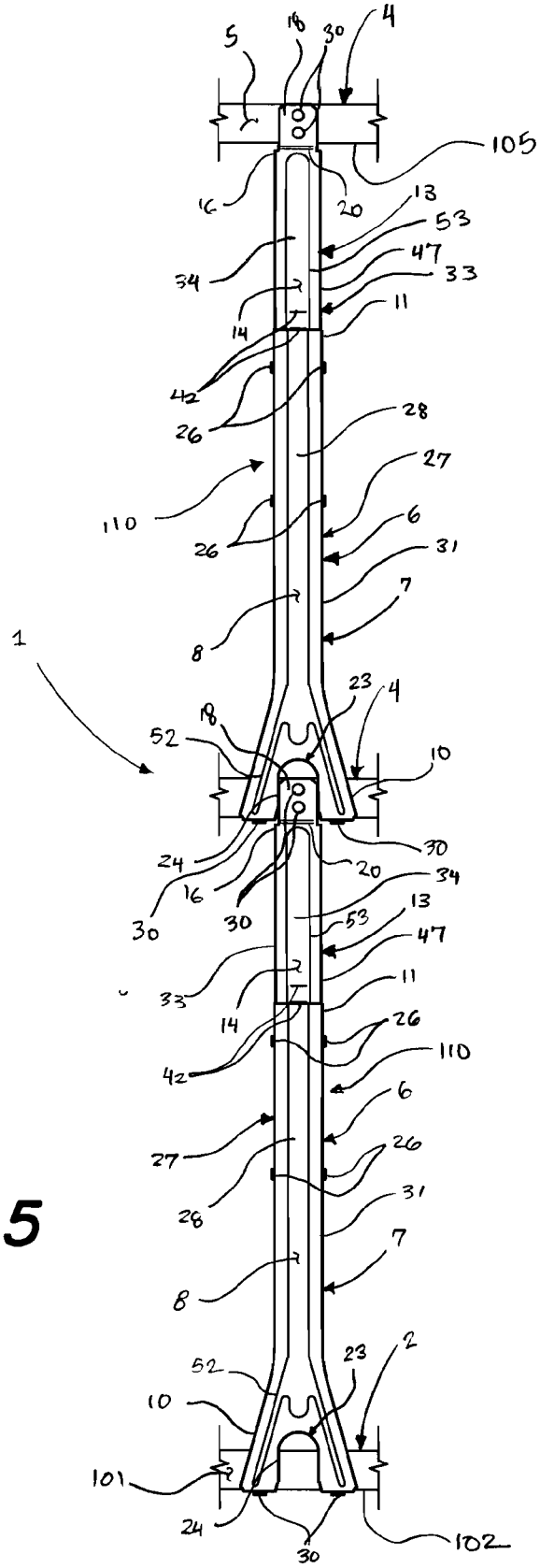
FIG. 15 is a top plan view of a connection of the present invention including two inline connectors and three connected structural members.
Figure 16:
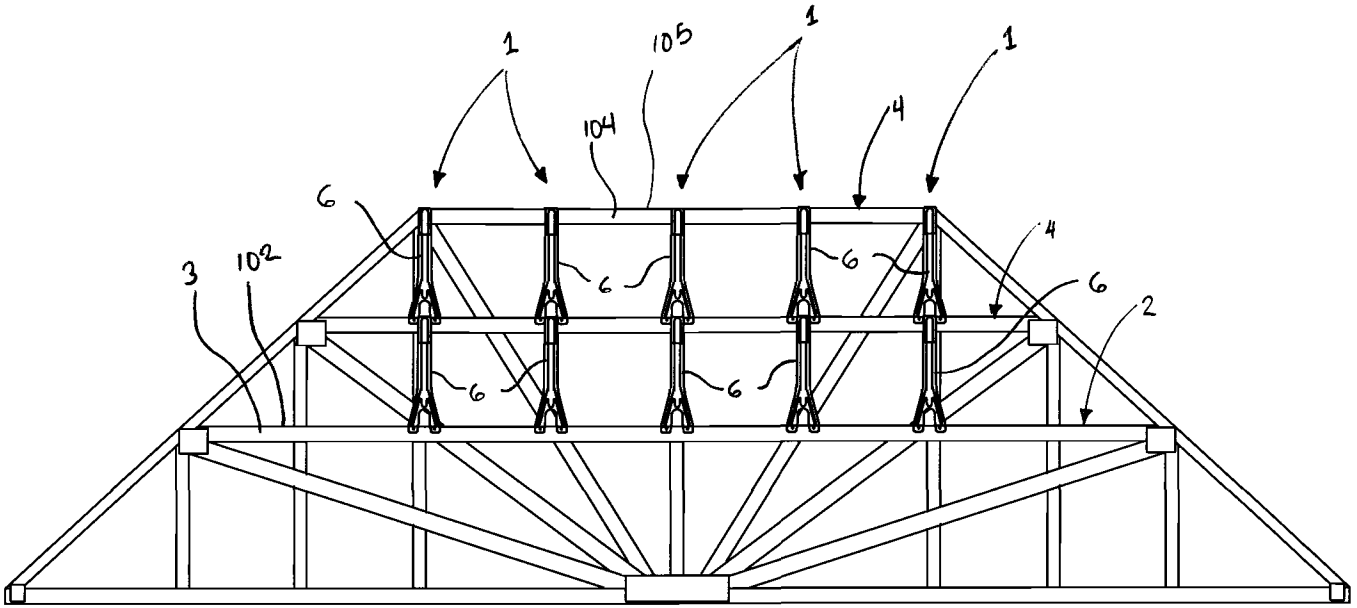
FIG. 16 is an elevation view of connections of the present invention including multiple inline connector pairs and three connected top chords.

As shown in FIGS. 15-16, the structural connection 1 can preferably include a second upper structural member 4 that is identical to the first upper structural member 4 in all relevant respects except that it is placed at a higher elevation in the building, and a second connector 6 that is identical to the first connector 6. Preferably, the first and second angularly-adjustable lower tabs 12 of the second connector 6 are attached to the second upper surface 104 of the first upper structural member 4 on either side of the first upper angularly-adjustable tab 18 of the first connector 6. The first angularly-adjustable upper tab 18 of the second connector 6 is attached to the first upper surface 5 of the second upper structural member 4. Any number of connectors 6 can be lined up in the manner to connector any number of structural members.

Preferably, the first and second angularly-adjustable lower tabs 12 of the second connector 6 are not in the same plane as the first upper angularly-adjustable tab 18 of the first connector 6. The first and second angularly-adjustable lower tabs 12 of the second connector 6 preferably are orthogonal to the first upper angularly-adjustable tab 18 of the first connector 6.

Figure 14:
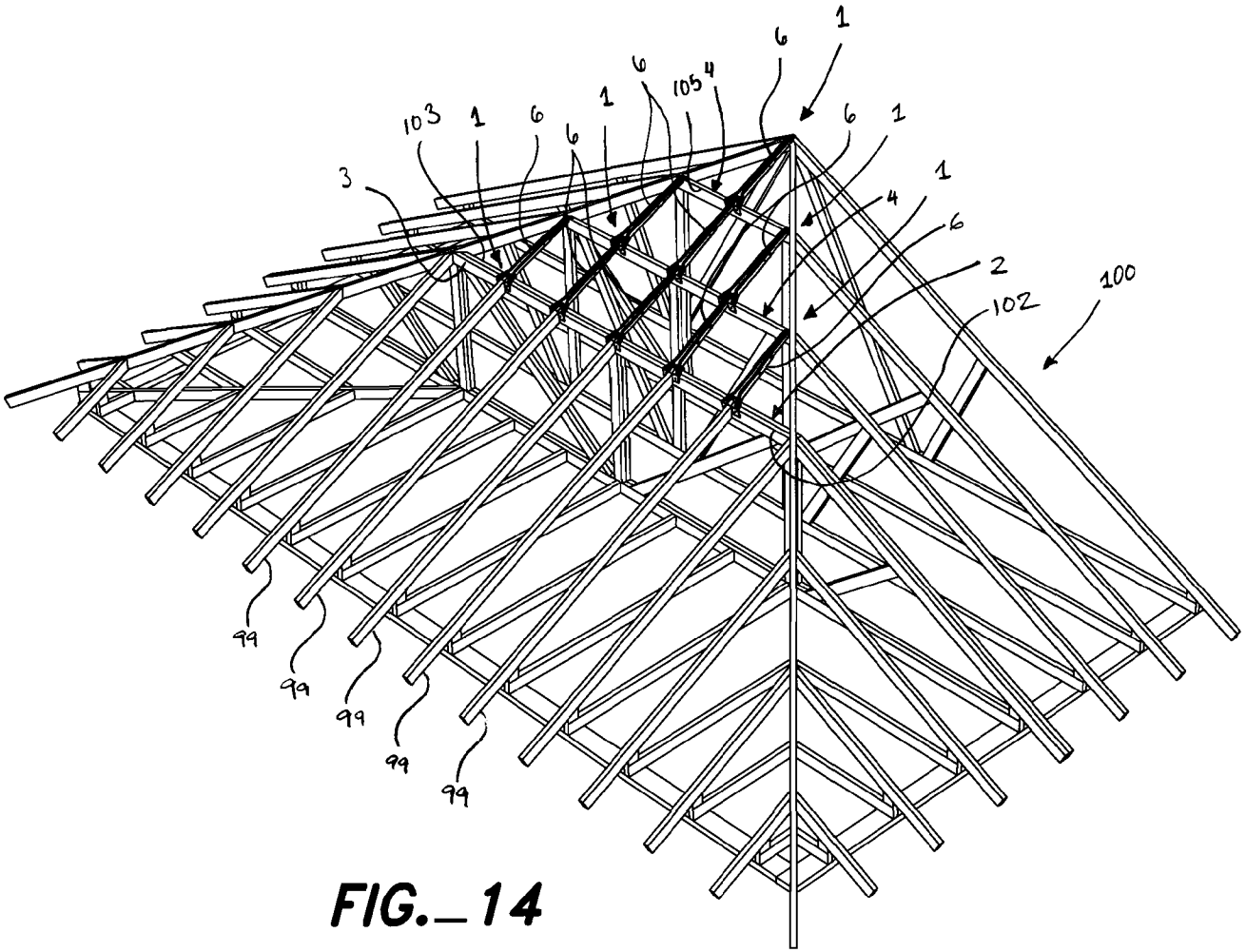
FIG. 14 is a perspective view of multiple connections of the present invention including multiple connectors and three step-down trusses in a hip roof structure.

As shown in FIG. 14, preferably the first and second connectors 6 are aligned with a top chord of an end jack 99.

Substantially flat sheathing 98 (shown in FIG. 11) is preferably attached to the first and second connectors 6, either directly or through the supporting structural members of the roof. ½" wood sheathing 98 is the preferred sheathing 98.

For wood installations, prior to installation, the connectors 6 are preferably set to the proper length and the two tube or channel-shaped elongate members 7, 13 are preferably fastened together with four #10×¾" self-drilling screws 26 through round holes 41 in the side flanges for pitches between 3/12 and 9/12; and in the triangular and upper round hole 41 when the connector will be used as an installation restraint and spacer at pitches 9/12 up to 12/12.

For trusses 2, 4 spaced 24" on center, the pitch markings 42 on the inner tube or channel-shaped elongated member 13 may be used to line up the elongated members 7, 13 to the correct length for a given pitch. For other spacings, the length of the connector 6 must be set to the calculated sloping length (from leading edge to leading edge of the framing members, which are the first lower juncture 102 and the first upper juncture 105).

To install the connectors 6 on wood trusses 2, 4, preferably use four 10*d* (0.148"×3") nails 30 when the wood trusses 2, 4 have 2×4 top chords, as preferred. The two nails 30 at the bottom of the part 6 (the yoke, or lower attachment, end 10 of the first elongate member 7) are preferably clinched, or bent over.

Sheathing 98 is preferably attached to the connector 6 with knurled pneumatic fasteners or low-profile-head, self-drilling screws. For efficiency, the connectors 6 should be installed in line with the end jacks 99 so that framing alignment can be maintained from eave to hip/ridge.

For cold formed steel installations, prior to installation, the connector 6 must be set to the proper length and the two tube or channel-shaped elongate members 7, 13 are preferably fastened together with four #10×¾" self-drilling screws 26 through the round holes 41 in the side flanges for pitches between 3/12 and 9/12; and in the triangular and upper round hole 41 when the connector 6 will be used as an installation restraint and spacer at pitches 9/12 up to 12/12.

For trusses 2, 4 spaced 24" on center, the pitch markings 42 on the inner tube or channel-shaped elongated member 13 may be used to line up the elongated members 7, 13 to the correct length for a given pitch. For other spacings, the length of the connector 6 must be set to the calculated sloping length (from leading edge to leading edge of the framing members, which are the first lower juncture 102 and the first upper juncture 105).

To install the AHEPs on CFS trusses 2, 4, preferably use four #10×¾" self-drilling screws 30.

Sheathing 98 is preferably attached to the connector 6 with knurled pneumatic fasteners or self-drilling screws.

For efficiency, the connectors 6 should be installed in line with the end jacks 99 so that framing alignment can be maintained from eave to hip/ridge.

I claim:

1. A structural connection (1) in a structure (100) comprising:

a. a first lower structural member (2) with a first lower surface (3) and a second lower surface (101), said first lower surface (3) and said second lower surface (101) being joined at a first lower juncture (102), said second lower surface (101) having a first lower inner edge (103) opposite said first lower juncture (102);

b. a first upper structural member (4) with a first upper surface (5) and a second upper surface (104), said first upper surface (5) and said second upper surface (104) being joined at a first upper juncture (105), said second upper surface (104) having a first upper inner edge (106) opposite said first upper juncture (105);

c. a connector (6) comprising:

i. a first elongate component (110) having a first elongate web (107) and a first elongate flange (108) that is angularly joined to said first elongate web (107) along a first elongate juncture (109); wherein:

(a) said connector (6) is attached to said lower structural member (2) and to said upper structural member (4);

(b) said upper structural member (4), where said connector (6) is attached, is elevated higher than said lower structural member (2), where said connector (6) is attached, within said structure (100);

(c) said first elongate web (107) extends from said first lower juncture (102) to said first upper juncture (105); and (d) said first elongate web (107) does not contact said first lower inner edge (103).

2. The structural connection (1) of claim 1 wherein:

a. said connector (6) is an adjustable-length connector (6); and b. said first elongate component (110) comprises a first elongate member (7) and a second elongate member (13) connected to said first elongate member (7).

3. The structural connection (1) of claim 2 wherein:

a. said first elongate member (7) has a first body portion (27) with:

i. a first web portion (28) with a first upper surface (8) and a first lower surface (9), a lower attachment end (10) and an upper end (11), said lower attachment end (10) including a first angularly-adjustable lower tab (12); and ii. a first lower flange portion (29) that is angularly joined to said first web portion (28) along a first lower juncture portion (32) and that has a first lower edge (37);

b. said second elongate member (13) has a second body portion (33) with:

i. a second web portion (34) with a second upper surface (14) and a second lower surface (15), an upper attachment end (16) and a lower end (17), said upper attachment end (16) including a first upper angularly-adjustable tab (18); and ii. a first upper flange portion (35) that is angularly joined to said second web portion (34) along a first upper juncture portion (36) and that has a first upper edge (38); wherein:

(a) one of said first upper surface (8) and said first lower surface (9) of said first web portion (28) interfaces with one of said second upper surface (14) and said second lower surface (15) of said second web portion (34);

(b) said first lower tab (12) interfaces with said first lower surface (3) of said lower structural member (2); and (c) said first upper tab (18) interfaces with said first upper surface (5) of said upper structural member (4).

4. The structural connection (1) of claim 3 wherein said first upper edge (38) tapers toward said first upper juncture portion (36) proximate said first upper tab (18).

5. The structural connection (1) of claim 4 wherein said lower attachment end (10) includes a second angularly-adjustable lower tab (12).

6. The structural connection (1) of claim 5 wherein:

a. said first and second lower tabs (12) are joined to said first body portion (27) of said first elongate member (7) at first and second lower angular junctures (19); and b. said first upper tab (18) is joined to said second body portion (33) of said second elongate member (13) at a first upper angular juncture (20).

7. The structural connection (1) of claim 6 wherein said first and second lower junctures (19) are discontinuous.

8. The structural connection (1) of claim 7 wherein:

a. said first upper tab (18) has a first width (21); and b. said first and second lower tabs (12) are separated by a spacing (22) at least equal to said first width (21).

9. The structural connection (1) of claim 8 wherein said first and second lower junctures (19) are separated by a slot (23) in said lower attachment end (10).

10. The structural connection (1) of claim 9 wherein said slot (23) is defined by an inner edge (24) reinforced by an edge flange (25).

11. The structural connection (1) of claim 10 wherein said slot (23) has first and second sides (39) joined by a curved end (40).

12. The structural connection (1) of claim 8 wherein said edge flange (25) tapers toward said inner edge (24) proximate said first and second lower tabs (12).

13. The structural connection (1) of claim 12 wherein said first elongate member (7) is fastened to said second elongate member (13) with a plurality of mechanical fasteners (26).

14. The structural connection (1) of claim 13 wherein said mechanical fasteners (26) are screws (26).

15. The structural connection (1) of claim 3 wherein:

a. said first lower surface (3) is a substantially vertical outer attachment surface (3); and b. said first upper surface (5) is a substantially horizontal upper attachment surface (5).

16. The structural connection (1) of claim 15 wherein:

a. said first and second lower tabs (12) are fastened to said outer attachment surface (3) with one or more separate fasteners (30); and b. said first upper tab (18) is fastened to said upper attachment surface (5) with one or more separate fasteners (30).

17. The structural connection (1) of claim 3 wherein:

a. said first elongate member (7) is formed at least in part as a first channel (31) wherein said first body portion (27) has a first web portion (28) with a first upper surface (8) and a first lower surface (9), a first lower side flange portion (29) and a second lower side flange portion (46) of a second elongate flange (108); and b. said second elongate member (13) is formed at least in part as a second channel (47) wherein said second body portion (33) has a second web portion (34) with said second upper surface (14) and said second lower surface (15), a first upper side flange portion (35) and a second upper side flange portion (51) of said second elongate flange (108).

18. The structural connection (1) of claim 16 wherein:

a. said first elongate member (7) broadens at said lower attachment end (10) such that said first web portion (28) broadens;

b. said first lower side flange portion (29) tapers toward said first lower tab (12); and c. said second lower side flange portion (46) tapers toward said second lower tab (12).

19. The structural connection (1) of claim 16 wherein:

a. said first upper side flange portion (35) tapers toward said first upper tab (18); and b. said second upper side flange portion (51) tapers toward said first upper tab (18).

20. The structural connection of claim 1 wherein:

a. said lower structural member (2) is a first step-down hip truss; and b. said upper structural member is (3) a second step-down hip truss.

21. The structural connection (1) of claim 5, additionally comprising:

a. a second upper structural member (4) identical to said first upper structural member (4); and b. a second connector (6) identical to said connector (6); wherein:

i. said first and second angularly-adjustable lower tabs (12) of said second connector (6) are attached to said second upper surface (104) of said first upper structural member (4) on either side of said first upper angularly-adjustable tab (18) of said connector (6);

ii. said first angularly-adjustable upper tab (18) of said second connector (6) is attached to said first upper surface (5) of said second upper structural member (4).

22. The structural connection (1) of claim 21 wherein said first and second angularly-adjustable lower tabs (12) of said second connector (6) are not in the same plane as said first upper angularly-adjustable tab (18) of said connector (6).

23. The structural connection (1) of claim 22 wherein said first and second angularly-adjustable lower tabs (12) of said second connector (6) are orthogonal to said first upper angularly-adjustable tab (18) of said connector (6).

24. The structural connection (1) of claim 21 wherein said connector (6) and said second connector(6) are aligned with a top chord of an end jack (99).

25. The structural connection (1) of claim 21 wherein substantially flat sheathing (98) is attached to said connector (6) and said second connector (6).

26. The structural connection (1) of claim 1 wherein:

a. said first elongate flange (108) does not pass through said lower structural member (2); and b. said first elongate flange (108) does not pass through said upper structural member (4).

* * * * *